United States Patent [19]

Hori et al.

[11] 4,123,371

[45] Oct. 31, 1978

[54] PROCESS FOR PREPARING OVER-BASED SULFURIZED ALKALINE EARTH METAL PHENATES

[75] Inventors: Takashi Hori; Suetou Hayashida, both of Soka, Japan

[73] Assignee: Maruzen Oil Co., Ltd., Osaka, Japan

[21] Appl. No.: 862,809

[22] Filed: Dec. 21, 1977

[30] Foreign Application Priority Data

Dec. 29, 1976 [JP] Japan ..... 51-160376

[51] Int. Cl.[2] ..... C10M 1/54; C10M 3/48; C10M 5/28; C10M 7/52

[52] U.S. Cl. ..... 252/42.7; 44/51

[58] Field of Search ..... 252/42.7; 44/51

[56] References Cited

U.S. PATENT DOCUMENTS 3,725,381 4/1973 Sakai et al. ..... 252/42.7

*Primary Examiner*—Irving Vaughn

*Attorney, Agent, or Firm*—Sughrue, Rothwell, Mion, Zinn and Macpeak

[57] ABSTRACT

A process for producing over-based sulfurized alkaline earth metal phenates useful as lubricating oil or fuel oil additives comprising reacting a phenol, sulfur, a dihydric alcohol and an alkaline earth metal oxide or hydroxide with about 0.99 to about 0.001 gram equivalents per phenolic hydroxyl group, and reacting the reaction product with carbon dioxide at a temperature of about 50° to about 230° C.

9 Claims, No Drawings

PROCESS FOR PREPARING OVER-BASED SULFURIZED ALKALINE EARTH METAL PHENATES

BACKGROUND OF THE INVENTION

1. Field of the Invention

This invention relates to a process for preparing a over-based alkaline earth metal phenate sulfide or sulfurized alkaline earth metal phenate by reacting a starting mixture in which the amount of a phenol is present in excess, and is directed to the commercially advantageous production of chemicals which are useful mainly as detergents or alkaline detergents for lubricating oils or fuel oils.

2. Description of the Prior Art

Basic phenates are generally used in lubricating oils for internal combustion engines, and exhibit a marked effect in preventing corrosive wear, formation of piston ring groove deposits, piston ring sticking, etc., by neutralizing or dispersing acids such as oxy acids or sulfuric acid, sludge, lacquers, carbon, etc.

From the standpoint of the function of acid neutralization, phenates can be classified into two types, one type being called normal phenates containing a theoretical amount, one gram equivalent, of metal per phenolic hydroxyl group; and the other type being called basic phenates or over-based phenates, e.g., as disclosed in U.S. Pat. No. 3,464,970 and British Pat. No. 1,280,749, containing metal in an amount larger than the theoretical amount, wherein a theoretical amount of 100% is considered the reaction of 1 gram equivalent of alkaline earth metal reacted per phenolic hydroxyl group (hereinafter the same). The present invention relates to a novel process for preparing basic or over-based phenates containing metal in an amount larger than the theoretical amount.

Heretofore, two typical methods for introducing sulfur into a phenate have been known. One method comprises converting an alkyl phenol to the sulfide thereof using sulfur monochloride or sulfur dichloride or the like and then converting the sulfide to a metal salt. The other method comprises sulfurizing the phenol at the time of adding a metal, or sulfurizing the metal phenate, using elemental sulfur. The present invention is based on the latter method of sulfurization.

Techniques relating to the latter type of sulfurization method are described in considerable detail in, for example, H. M. Drew, *Metal-Based Lubricant Compositions, Chemical Technology Review,* No. 48, Noyes Data Corp., Park Ridge, New Jersey, (1975), pp. 6–15. Those considered to be comparatively relevant to the present invention are described below.

U.S. Pat. Nos. 2,680,096 and 2,680,097, for example, describe a process for preparing sulfurized phenates by heating a mixture of an alkyl phenol, an alkaline earth metal oxide or hydroxide, ethylene glycol and sulfur. This process is the first successful utilization of the finding by L. Haitinger (as disclosed in *Monat Chemie,* 4, 165 (1883)) on the reaction of sodium phenoxide with elemental sulfur in a method of preparing lubricating oil additives. However, these basic phenates were considered to be only half-finished products as lubricating oil additives in view of their stability or oil solubility.

The method, for example, disclosed in U.S. Pat. No. 3,036,971, is considered an advance over the process disclosed in U.S. Pat. No. 2,680,096 in the use of an additional step of treating the product obtained with carbon dioxide.

However, in these processes, a basic phenate containing a calcium content of only about 170%, based on the theoretical amount, can be obtained even if calcium hydroxide is used in an amount of slightly more than 200% of the theoretical amount based on the starting alkyl phenol (see U.S. Pat. No. 3,036,971).

The method disclosed in U.S. Pat. No. 3,194,761 is a basic improvement in the process described in U.S. Pat. No. 3,036,971 and is successful in incorporating calcium in the alkyl phenol in an amount of about 1.5 times the amount of calcium incorporated in U.S. Pat. No. 3,036,971.

British Pat. No. 900,059 discloses a process quite similar to those set forth in U.S. Pat. Nos. 2,680,096 and 3,036,971, i.e., a process comprising reacting an alkylphenol with elementary sulfur, an alkaline earth metal salt and a dihydric alcohol, removing only water from the reaction product, heating the water-free reaction product together with carbon dioxide in the presence of a dihydric alcohol, and then reacting the resultant product additionally with the dihydric alcohol and alkaline earth metal salt. In this process, the amount of alkaline earth metal reacted at one time is small.

These methods in U.S. Pat. No. 3,194,761 and British Pat. No. 900,059, however, require an additional step, in which a polyhydric alcohol and calcium hydroxide must be added again.

On the other hand, U.S. Pat. No. 3,178,368 discloses a successful incorporation of a large quantity of an alkaline earth metal based on the alkyl phenol. According to this method, an alkaline earth metal sulfonate and a small amount of a higher alcohol must be further added to the starting materials used in the process described in U.S. Pat. No. 3,036,971.

On the other hand, Sakai and the present inventor have discovered the presence of a group of over-based phenates containing a larger excess of alkaline earth metal than prepared in conventional methods, and processes for their production (e.g., as disclosed in Japanese Pat. Nos. 533,078, 533,079 and 613,542; T. Hori et al., *Bull. Japan Petrol. Inst.,* 16, 1 (1974); ibid., 16, 106 (1974); ibid., 17, 193 (1975)). These processes essentially require the use of a higher alcohol.

The known techniques described above each have their own characteristics as set forth hereinabove. These prior techniques are based on a fundamentally important common technical concept. An especially important aspect of this common technical concept is the mixing ratio between the phenol and the alkaline earth metal agent in the preparation of basic phenates. All of the conventional techniques have employed the method typically exemplified by the statement by W. T. Stewart and F. A. Stuart in *Advances in Petroleum Chemistry and Refining,* J. J. Mcketta, Jr., Ed., Vol. 7, Interscience Publishing Company, New York (1963) that "Basic phenates can be produced by use of an excess of alkaline earth metal oxides or hydroxides over the theoretical amounts required to form the normal phenate, (i.e., one equivalent of metal per equivalent of substituted phenol), namely by using alkaline earth metal oxides or hydroxides in excess of the gram equivalent of the alkyl phenol." In addition, the disclosure in U.S. Pat. Nos. 2,680,096, 2,680,097, 3,036,971 and 3,178,368 and other prior art is that it is preferred to use a blending ratio between the alkaline earth metal agent and the phenol of 5 to 10% larger than the ratio between the alkaline earth metal and the phenol desired in the final basic phenates. Such a technical concept on the blending ratio between the alkaline earth metal agent and the phenol, as far as is known, apparently has been quite universal in the field of producing these basic phenates.

On the other hand, from a commercial viewpoint, the conversion yield based on the alkaline earth metal agent in these prior techniques is low, and the content of the alkaline earth metal in the final products is at most about 170% based on the theoretical amount. To increase the metal in the final products requires a repetition of a metal addition step or the use of a higher alcohol solvent. Hence, the entire process becomes complicated since the process requires a solvent recovery step, for example.

SUMMARY OF THE INVENTION

Extensive investigations have now been made in order to establish a process for preparing over-based phenates which is free from the various difficulties associated with conventional prior art techniques. These investigations have led to the new discovery that over-based sulfurized alkaline earth metal phenates having a high T.B.N. (total basic number) can be prepared more effectively by use of a blending ratio between the alkaline earth metal agent and the phenol of smaller than the ratio between the metal and the phenol in the normal phenate, i.e., of about 0.99 equivalents or less of alkaline earth metal agent per equivalent of phenolic hydroxyl group of the blending phenol. This method is quite in contrast to the conventional technical concept described hereinabove.

A primary object of this invention is to provide a novel process for preparing over-based phenates having a high ability to neutralize acids.

A secondary object of this invention is to provide a process for preparing over-based phenates in which the starting materials are utilized quite efficiently, and the manufacturing steps are greatly simplified.

According to the present invention, a process for preparing an over-based sulfurized alkaline earth metal phenate is provided, which comprises reacting a phenol, sulfur, a dihydric alcohol and an alkaline earth metal oxide or hydroxide with the gram equivalent ratio of the alkaline earth metal agent per phenolic hydroxyl group being maintained at about 0.99 to about 0.001 and then reacting the reaction product with carbon dioxide at a temperature of about 50° C. to about 230° C.

DETAILED DESCRIPTION OF THE INVENTION

Suitable phenols which can be used in this invention include, for example, phenols which contain a hydrocarbon side chain containing 4 to 36 carbon atoms, preferably 8 to 32 carbon atoms, such as an alkyl group, an alkenyl group or an aralkyl group. Specifically, phenols containing a hydrocarbon group such as butyl, amyl, octyl, nonyl, dodecyl, cetyl, ethylhexyl or triacontyl, or a hydrocarbon group (e.g., having 8 to 32 carbon atoms) derived from a petroleum hydrocarbon, such as white oil, paraffin, waxes having a melting point of about 30° C. to about 70° C. or polyolefins having a molecular weight of about 56 to 504 (e.g., polyethylene, polypropylene or polybutene) can be used, either individually or as mixtures. Preferred phenols are those which are liquid usually at about 130° C., preferably at 120° C.

The alkaline earth metal agent can be an alkaline earth metal oxide or an alkaline earth metal hydroxide. Suitable examples thereof are the oxides or hydroxides of calcium, barium and strontium. The oxides or hydroxides of calcium and barium are especially preferred. The desired over-based phenates can be obtained by using the alkaline earth metal agent in an amount which is about 0.99 or less gram equivalent per phenolic hydroxyl group equivalent. If the gram equivalent ratio of the alkaline earth metal agent to the phenol is less than about 0.001, more generally less than 0.01, the process is disadvantageous in the performance of and yield of the product obtained as well as in terms of the economics. If, on the other hand, the gram equivalent ratio of the alkaline earth metal agent to the phenol exceeds about 0.99, it is difficult to produce over-based phenates.

Suitable dihydric alcohols which can be employed are preferably those which have a low boiling point and a low viscosity and a high reactivity. Specifically, suitable dihydric alcohols are those having 2 to 6 carbon atoms, and ethylene glycol is most preferred. The amount of the dihydric alcohol used is about 10 to about 65 mol%, preferably 15 to 55 mol%, based on the total mols of the alkaline earth metal agent, the phenol and the dihydric alcohol.

The amount of sulfur can be varied over a wide range. The usual amount of sulfur is about 0.001 to about 4.0 mols, preferably 0.001 to 3.0 mols, per mol of the alkaline earth metal agent. If the amount of sulfur is outside the specified range, sulfurized over-based phenates with the desired characteristics cannot be obtained. All allotropic forms of sulfur can be used.

Diluents may be employed to facilitate the handling of the reactants, the reaction intermediates, and the products. For example, when the excess unreacted phenol is to be recovered by distillation from the reaction product treated with carbon dioxide, distillation in the presence of a suitable diluent can afford a distillation residue in the liquid state. Usually, a portion of the diluent distills off with the distillation of the unreacted phenol. Hence, the diluent should preferably be one which does not directly affect the reaction adversely, when the recovered phenol is repeatedly reused in the reaction.

Examples of preferred diluents are petroleum fractions, e.g., lubricating oil fractions having boiling points of about 220° C. to 550° C. and a viscosity of about 2 to 40 CS at 100° C., such as paraffinic, naphthenic, aromatic or mixed base stocks. Other organic solvents such as alkylbenzenes, α-olefin polymers, etc., having a boiling point and a viscosity in the above ranges may be used as diluents so long as they are hydrophobic and oleophilic, and are non-toxic during the reaction or in products in end use.

The main steps and operating conditions employed in the process of this invention to prepare over-based phenates are described in detail below.

(A) Sulfurization Metal Addition Step

A phenol, sulfur, a dihydric alcohol and 0.99 to 0.001 gram equivalent, preferably 0.98 to 0.01 gram equivalent, per equivalent of the phenolic hydroxy group, of an alkaline earth metal agent are reacted at a temperature of about 60° to about 200° C., preferably 90° to 190° C. The hydrogen sulfide generated at this time, preferably, is removed from the reaction system. If hydrogen sulfide is insufficiently removed, side reactions occur or unreacted substances remain in the subsequent reaction steps. It is preferred for the water generated in this step to be distilled off in an amount of at least about 30% by weight before the subsequent step of treatment with carbon dioxide. If removal of the water generated is less than 30% by weight, a precipitate of alkaline earth metal carbonate is formed when the reaction product is contacted with carbon dioxide and, in some cases, substantially all of the alkaline earth metal is converted into a precipitate. This step of the process of this invention is usually completed in about 1 to about 9 hours.

(B) Carbon Dioxide Treatment Step

The liquid distillation residue after the completion of the sulfurization-metal addition step (A) described above is reacted with carbon dioxide under an applied pressure, normal pressure or reduced pressure at a temperature of about 50° to about 230° C., preferably 80° to 200° C., to give about 0.05 to about 2.0 mols, preferably 0.1 to 1.5 mols, of absorbed carbon dioxide per mol of alkaline earth metal in the reaction product. A reaction under pressure is completed more rapidly than under reduced pressure and, thus, is preferred. If desired, the resulting product can be additionally maintained under an atmosphere of carbon dioxide at about 100° to about 230° C. for several minutes to ten to twenty hours, preferably 0.5 to 10 hours. If desired, the reaction product after the treatment with carbon dioxide may be subjected again with the metal addition reaction by adding a fresh alkaline earth metal agent and dihydric alcohol, and then the product treated with carbon dioxide at least once. Preferably, a part, or most, of the unreacted phenol in the reaction product solution obtained after the treatment with carbon dioxide is recovered to operate the process of this invention economically. The phenol so recovered may also be recycled and used as a starting material. The excess dihydric alcohol remaining in the metal addition step is recovered before and/or after the treatment with carbon dioxide. If the unreacted phenol is recovered by distillation performed in the presence of an ordinary diluent such as a lubricating oil fraction, the distillation residue can be obtained as a liquid. The insoluble materials in the reaction product solution can be removed by procedures such as filtration or centrifugal separation before or after the recovery of the phenol.

The present invention thus can be used to prepare an over-based phenate having a large amount of an alkaline earth metal added per unit amount of phenol in a good yield based on the metal used, despite the fact that a relatively simple process and a small number of starting materials are used.

The present invention is specifically illustrated in greater detail by reference to the following Examples 1 to 9 and Comparative Example. Unless otherwise indicated herein, all parts, percents, ratios and the like are by weight.

EXAMPLE 1

A 2-liter four-necked flask equipped with a stirrer, a condenser tube, a nitrogen gas inlet tube and a thermometer was charged with 1233.7 g (5.6 mols) of nonyl phenol, 10.8 g of sulfur and 32.0 g (0.56 mol) of calcium oxide having a purity of 98.3%, and the starting materials were stirred. Ethylene glycol (118.2 g) was added to the resulting suspension in a stream of nitrogen at 132° C. under atmospheric pressure. The mixture was stirred at 135° C. for about 5 hours. Then, while the pressure in the reaction system was gradually reduced, the water generated in the reaction, most of the unreacted ethylene glycol and a small amount of the nonyl phenol were distilled off, whereupon 1276.4 g of a dark yellowish green liquid distillation residue was obtained. The temperature of the final distillate was 87° C. (6 mm Hg).

Then, 1266.2 g of the distillation residue obtained as described above was placed in an autoclave, and caused to absorb carbon dioxide under an elevated pressure (not more than 11 kg/cm$^2$) at a temperature of 123° to 126° C. The reaction system was then maintained at 155° C. for 2 hours under an elevated pressure (not more than 8 kg/cm$^2$) to produce 1289.5 g of a dark yellowish green reaction product solution.

A 2-liter pear-shaped two-necked flask was charged with 1278.3 g of the reaction product solution obtained after the carbon dioxide treatment described above and 133.7 g of a 150 neutral oil (a paraffinic lubricating oil having a viscosity of 5,386 CS at 210° F.). A small amount of ethylene glycol, most of the unreacted nonyl phenol and a small amount of a lubricating oil fraction were distilled off from the mixture under reduced pressure to obtain 262.1 g of a distillation residue. The temperature of the final distillate was 167° C. (3 mm Hg).

After the extremely small amounts of insoluble materials present in the distillation residue were removed by, e.g., filtration or centrifugal separation, 261.4 g of a very dark yellow, clear, viscous liquid product was obtained.

Material balance calculations showed that the product contained 281%, based on the theoretical amount, of calcium per phenolic hydroxyl group equivalent of the nonyl phenol reacted.

Analysis of the final product gave the following results:

| | |
|---|---|
| Viscosity (CS at 210° F): | 318.7 |
| T.B.N. (Total Basic Number): (JIS K 2500; KOH mg/g) | 232 |
| Calcium (wt%): | 8.40 |
| Sulfur (wt%): | 2.31 |

EXAMPLE 2

The same experimental device as described in Example 1 was charged with 771.1 g (3.5 mols) of nonyl phenol, 22.5 g of sulfur and 78.5 g (1.4 mols) of calcium oxide having a purity of 99.9% in a stream of nitrogen under atmospheric pressure, and the starting materials were stirred. Ethylene glycol (313.0 g) was added to the resulting suspension in a stream of nitrogen at 130° C. under atmospheric pressure. The mixture was stirred for about 5 hours at 135° C. While the pressure in the reaction system was gradually reduced, the water generated in the reaction and 99.3 g of ethylene glycol (a part of the unreacted ethylene glycol) were distilled off, whereupon 1053.7 g of a dark yellowish green liquid distillation residue was obtained. The temperature of the final distillate was 105° C. (15 mm Hg).

Then, 1045.6 g of the distillation residue produced as described above was placed in an autoclave, and reacted with carbon dioxide under an elevated pressure (not more than 11 kg/cm$^2$) at a temperature of 127° C. Then, the system was maintained at 155° C. and under an elevated pressure of not more than 8.7 kg/cm$^2$ for 2 hours to produce 1119.7 g of a crimson reaction product solution.

A 2-liter pear-shaped two-necked flask was charged with 1108.9 g of the reaction product solution obtained after the carbon dioxide treatment as described above and 226.7 g of a 150 neutral oil (described in Example 1), and in a stream of nitrogen under reduced pressure, the unreacted ethylene glycol, most of the unreacted nonyl phenol and a small amount of an oil fraction were distilled off from the mixture to obtain 536.5 g of a distillation residue. The temperature of the final distillate was 179° C. (3 mm Hg).

When the small amounts of insoluble materials present in the distillation residue were removed by, e.g., filtration or centrifugal separation, 532.7 g of a very dark yellow, clear, viscous liquid product was obtained.

The final product had the following characteristics.

| | |
|---|---|
| Viscosity (CS at 210° F): | 879.4 |
| T.B.N. (JIS K 2500; KOH mg/g): | 275 |
| Calcium Content (% based on the theoretical amount): | 361 |
| Calcium (wt%): | 10.1 |
| Sulfur (wt%): | 3.67 |

EXAMPLE 3

The procedures of Example 2 were repeated except that the molar ratio of calcium oxide to nonyl phenol was changed to 0.286, and the amount of sulfur was decreased to about one-tenth the amount used in Example 2.

More specifically, ethylene glycol (147.8 g) was added in a stream of nitrogen at 130° C. under atmospheric pressure to a suspension obtained by blending 1079.5 g (4.9 mols) of nonyl phenol, 2.25 g of sulfur and 79.7 g (1.4 mols) of calcium oxide with a purity of 98.5%. The resulting mixture was stirred at 135° C. for 5 hours. While the pressure in the reaction system was gradually reduced, the water generated in the reaction, most of the unreacted ethylene glycol and a small amount of nonyl phenol were distilled off, whereupon 1277.0 g of a dark yellowish green liquid distillation residue was obtained. The temperature of the final distillate was 99° C. (18 mm Hg).

Then, 1265.5 g of the distillation residue was caused to absorb carbon dioxide at 123° to 129° C. under an elevated pressure of not more than 11.0 kg/cm$^2$, and then the system was maintained at an elevated pressure (not more than 8.7 kg/cm$^2$) and 155° C. for 2 hours to produce 1332.6 g of a reaction product solution. Then, 1319.4 g of the reaction product solution obtained as described above was mixed with 332.8 g of a 150 neutral oil (described in Example 1), and in a stream of nitrogen under reduced pressure, a small amount of ethylene glycol, most of the unreacted nonyl phenol and a small amount of a lubricating oil fraction were distilled off from the mixture to obtain 625.9 g of a liquid distillation residue. The temperature of the final distillate was 181° C. (3.5 mm Hg). Removal of 1.6 g of n-hexane-insoluble materials from the residue resulted in a final product having the following characteristics.

| | |
|---|---|
| Viscosity (CS at 210° F): | 114.7 |
| T.B.N. (JIS K 2500; KOH mg/g): | 240 |
| Calcium Content (based on the theoretical amount, %): | 336 |
| Calcium (wt%): | 8.82 |
| Sulfur (wt%): | 0.31 |

EXAMPLE 4

The procedures of Example 1 were repeated except that the mol ratio of calcium oxide to nonyl phenol was changed to 0.286, and the treatment with carbon dioxide was carried out at a more elevated temperature.

More specifically, ethylene glycol (147.8 g) was added in an atmosphere of nitrogen at 130° C. under atmospheric pressure to a suspension obtained by blending 1079.5 g (4.9 mols) of nonyl phenol, 27.0 g of sulfur and 78.4 g (1.4 mols) of calcium oxide having a purity of 99.9%. The mixture was stirred at 135° C. for 5 hours, and while gradually reducing the pressure in the reaction system, the water generated in the reaction, most of the unreacted ethylene glycol and a small amount of nonyl phenol were distilled off to produce 1261.6 g of a dark yellowish green distillation residue. The temperature of the final distillate was 100° C. (6 mm Hg).

Then, 1192.4 g of the distillation residue produced as described above was caused to absorb carbon dioxide at an elevated pressure of not more than 11.0 kg/cm$^2$ at 153° to 156° C., and then the reaction system was maintained at an elevated pressure (3.5 to 7.0 kg/cm$^2$) at 185° C. for 2 hours to produce 1239.7 g of a reaction product solution. Then, 1228.7 g of the reaction product solution produced as described above was mixed with 335.0 g of a 150 neutral oil (described in Example 1). When a small amount of ethylene glycol, most of the unreacted nonyl phenol and a small amount of a lubricating oil fraction were distilled off from the mixture in a stream of nitrogen under reduced pressure, 667.3 g of a liquid distillation residue was obtained. The temperature of the final distillate was 163° C. (5 mm Hg). Removal of 1.2 g of n-hexane-insoluble materials from the residue resulted in a final product having the following characteristics.

| | |
|---|---|
| Viscosity (CS at 210° F): | 116.8 |
| T.B.N. (JIS K 2500; KOH mg/g): | 228 |
| Calcium Content (based on the theoretical amount, %): | 280 |
| Calcium (wt%): | 8.16 |
| Sulfur (wt%): | 3.02 |

EXAMPLE 5

The procedures of Example 1 were repeated except that the mol ratio of calcium oxide to nonyl phenol was changed to 0.286, and the temperature used in the metal addition step was elevated.

More specifically, ethylene glycol (141.8 g) was added in a stream of nitrogen at 165° C. under atmospheric pressure to a suspension obtained by blending 1035.4 g (4.7 mols) of nonyl phenol, 25.9 g of sulfur and 76.6 g (1.34 mols) of calcium oxide having a purity of 98.3%. The mixture was stirred at 167° C. for 5 hours, and then the temperature of the reaction system was reduced to 140° C. While gradually reducing the pressure of the reaction system, the water generated in the reaction, most of the unreacted ethylene glycol and a small amount of nonyl phenol were distilled off to obtain 1137.1 g of a liquid distillation residue. The temperature of the final distillate was 94° C. (7 mm Hg).

Then, 1132.1 g of the distillation residue produced as described above was caused to absorb carbon dioxide at an elevated pressure of not more than 11 kg/cm$^2$ at 126° to 128° C., and then the reaction system was maintained at 156° C. and an elevated pressure (10.8 kg/cm$^2$) for 2 hours to produce 1186.2 g of a dark yellow reaction product solution.

The reaction product solution (1171.3 g) produced as described above was mixed with 322.9 g of a 150 neutral oil (described in Example 1). When a small amount of ethylene glycol, most of the unreacted nonyl phenol and a small amount of a lubricating oil fraction were distilled off from the mixture in a stream of nitrogen under reduced pressue, 789.2 g of a liquid viscous distillation residue was obtained.

Removal of 1.5 g of n-hexane-insoluble materials from the residue resulted in a final product having the following characteristics.

| | |
|---|---|
| Viscosity (CS at 210° F): | 218.1 |
| T.B.N. (JIS K 2500; KOH mg/g): | 186 |
| Calcium Content (based on the theoretical amount, %): | 220 |
| Calcium (wt%): | 6.63 |
| Sulfur (wt%): | 2.24 |

EXAMPLE 6

The procedures of Example 2 were repeated except that the molar ratio of calcium oxide to nonyl phenol was changed to 0.286, and the molar ratio of sulfur to calcium oxide was increased to 3.0.

More specifically, ethylene glycol (239.1 g) was added in a stream of nitrogen under atmospheric pressure at 130° C. to a suspension obtained by blending 848.2 g (3.85 mols) of nonyl phenol, 105.9 g of sulfur and 62.7 g (1.1 mols) of calcium oxide having a purity of 98.5%. The mixture was stirred at 135° C. for 6 hours. While gradually reducing the pressure in the reaction system, the water generated in the reaction was distilled off to obtain 1216.8 g of a very dark red distillation residue. The temperature of the final distillate was 117° C. (51 mm Hg).

Then, 1201.3 g of the distillation residue produced as described above was caused to absorb carbon dioxide under an elevated pressure of not more than 11.5 kg/cm$^2$ at 125° C., and then the reaction system was maintained under an elevated pressure (7.8 kg/cm$^2$) at 155° C. for 2 hours to obtain 1230.6 g of a very dark red reaction product solution.

The reaction product solution (1194.5 g) obtained as described above was mixed with 255.8 g of a 150 neutral oil (described in Example 1). When most of the unreacted ethylene glycol and unreacted nonyl phenol and a small amount of a lubricating oil fraction were distilled off from the mixture in a stream of nitrogen under reduced pressure, 823.7 g of a very dark red viscous liquid distillation residue was obtained. The temperature of the final distillate was 178° C. (3 mm Hg). Removal of 1.0 g of n-hexane-insoluble materials from the residue resulted in a final product having the following characteristics.

| | |
|---|---|
| Viscosity (CS at 210° F): | 89.2 |
| T.B.N. (JIS K 2500; KOH mg/g): | 144 |
| Calcium Content (based on the theoretical amount, %): | 110 |
| Calcium (wt%): | 5.15 |
| Sulfur (wt%): | 5.61 |

EXAMPLE 7

In this Example, recovered nonyl phenol containing a mineral oil as a diluent and ethylene glycol were used as a starting material.

More specifically, ethylene glycol (37.6 g) was added in a stream of nitrogen under atmospheric pressure at 130° C. to a suspension obtained by blending 1336.6 g (4.55 mols as nonyl phenol) of recovered nonyl phenol containing 7.5% of ethylene glycol and 17.5% of a lubricating oil fraction, 25.0 g of sulfur and 74.3 g (1.3 mols) of calcium oxide having a purity of 98.5%. The mixture was stirred at 135° C. for 4 hours. While gradually reducing the pressure in the reaction system, the water generated in the reaction, most of the unreacted ethylene glycol and a small amount of nonyl phenol were distilled off to obtain 1343.7 g of a liquid distillation residue. The temperature of the final distillate was 82° C. (5 mm Hg).

Then, 1334.6 g of the distillation residue produced as described above was caused to absorb carbon dioxide under an elevated pressure of not more than 11.0 kg/cm$^2$ at 122° to 126° C., and then the reaction system was maintained under an elevated pressure (13 kg/cm$^2$) at 155° C. for 2 hours to obtain 1386.8 g of a reaction product solution.

The reaction product solution (1370.4 g) produced as described above was mixed with 75.7 g of a 150 neutral oil (described in Example 1), and a small amount of ethylene glycol, most of the unreacted nonyl phenol and a small amount of a lubricating oil fraction were distilled off from the mixture in a stream of nitrogen under reduced pressure to obtain 631.6 g of a liquid distillation residue. The temperature of the final distillate was 183° C. (5 mm Hg).

Removal of 1.8 g of n-hexane-insoluble materials from the residue resulted in a final product having the following characteristics.

| | |
|---|---|
| Viscosity (CS at 210° F): | 225.6 |
| T.B.N. (JIS K 2500; KOH mg/g): | 218 |
| Calcium Content (based on the theoretical amount, %): | 220 |
| Calcium (wt%): | 8.0 |
| Sulfur (wt%): | 3.13 |

EXAMPLE 8

An alkyl phenol obtained by alkylating phenol with a mixture of α-olefins containing 6 to 28 carbon atoms (which is an ethylene telomer) was used as a starting material in this Example.

More specifically, a suspension was formed by blending 1410 g (4.49 mols) of an alkyl phenol isomeric mixture (42% ortho-isomer, 42% para-isomer and 16% meta-isomer) having a number average molecular weight of 314 and obtained by alkylating phenol with a mixture of α-olefins (an ethylene telomer having 6 to 28 carbon atoms and containing more than 88.6 % of straight-chain alkenes), 24.7 g of sulfur, and 73.0 g (1.28 mols) of calcium oxide having a purity of 98.3%. Ethylene glycol (135.1 g) was added to the suspension in a stream of nitrogen under atmospheric pressure at 130° C., and the mixture was stirred at 135° C. for 5 hours. While gradually reducing the pressure in the reaction system, the water generated in the reaction, most of the unreacted ethylene glycol and a small amount of the alkyl phenol were distilled off to obtain 1529.3 g of a liquid distillation residue. The temperature of the final distillate was 67° C. (2 mm Hg).

Then, 1518.2 g of the distillation residue produced as described above was caused to absorb carbon dioxide under an elevated pressure of not more than 11.0 kg/cm$^2$ at 124° C., and then the reaction system was maintained under an elevated pressure (7.0 kg/cm$^2$) at 155° C. for 2 hours to obtain 1576.2 g of a very dark red reaction product solution.

The reaction product solution (1549.9 g) produced as described above was mixed with 235.9 g of a 150 neutral oil (described in Example 1). When a small amount of ethylene glycol, a part of the alkyl phenol and a small amount of a lubricating oil fraction were distilled off from the mixture in a stream of nitrogen under reduced pressure, 968.0 g of a liquid distillation residue was obtained. The temperature of the final distillate was 220° C. (1.5 mm Hg).

Removal of 2.2 g of n-hexane-insoluble materials from the residue resulted in a final product having the following characteristics.

| | |
|---|---|
| Viscosity (CS at 210° F): | 40.7 |
| T.B.N. (JIS K 2500; KOH mg/g): | 147 |
| Calcium Content (based on the theoretical amount, %): | 300 |
| Calcium (wt%): | 5.16 |
| Sulfur (wt%): | 1.62 |

EXAMPLE 9

Dodecyl phenol was used as the phenol in this Example, and the procedures described in Example 1 were repeated.

More specifically, ethylene glycol (141.8 g) was added in a stream of nitrogen at 129° C. to a suspension obtained by blending 1233.3 g (4.7 mols) of dodecyl phenol, 25.9 g of sulfur and 76.6 g (1.34 mols) of calcium oxide having a purity of 98.5%. The mixture was stirred at 135° C. for 4 hours. While graudually reducing the pressure in the reaction system, the water generated in the reaction, most of the unreacted ethylene glycol, and a small amount of dodecyl phenol were distilled off to obtain 1349.2 g of a liquid distillation residue. The temperature of the final distillate was 112° C. (5 mm Hg).

Then, 1338.6 g of the distillation residue produced as described above was caused to absorb carbon dioxide under an elevated pressure of not more than 10.0 kg/cm$^2$ at 125 to 127° C., and then the reaction system was maintained under an elevated pressure (6.0 kg/cm$^2$) at 150° C. for 1.5 hours to obtain 1395.5 g of a reaction product solution.

The reaction product solution (1372.2 g) produced as described above was mixed with 289.5 g of a 150 neutral oil (described in Example 1). When a small amount of ethylene glycol, most of the unreacted dodecyl phenol and a small amount of a lubricating oil fraction were distilled off from the mixture in a stream of nitrogen under reduced pressure, 677.2 g of a liquid viscous distillation residue was obtained.

Removal of 1.7 g of n-hexane-insoluble materials from the residue resulted in a final product having the following characteristics.

| | |
|---|---|
| Viscosity (CS at 210° F): | 173.7 |
| T.B.N. (JIS K 2500; KOH mg/g): | 211 |
| Calcium Content (based on the theoretical amount, %): | 240 |
| Calcium (wt%): | 7.5 |
| Sulfur (wt%): | 2.9 |

COMPARATIVE EXAMPLE

One embodiment of the prior art in which a blending ratio of the starting materials different from the present invention is shown in this Example. Calcium oxide was used in an amount of 1.1 mols per mol of the alkyl phenol. A gel-like intermediate was formed, but the desired final product could not be obtained.

More specifically, ethylene glycol (200.6 g) was added in a stream of nitrogen at 130° C. to a suspension obtained by blending 376.7 g (1.71 mols) of nonyl phenol, 36.6 g of sulfur and 108.4 g (1.90 mols) of calcium oxide having a purity of 98.3%. The mixture was stirred at 135° C. for 5 hours. When the pressure in the reaction system was gradually reduced, the solution which was a yellow green semi-transparent solution foamed with the distillation off of the water generated in the reaction. When 20 ml of the water generated in the reaction had distilled off, a gel-like product was formed, and it was impossible to stir the reaction mixture. Hence, no further procedures were conducted. The temperature of the distillate when further procedures were impossible was 53° C. (28 mm Hg).

While the invention has been described in detail and with reference to specific embodiments thereof, it will be apparent to one skilled in the art that various changes and modifications can be made therein without departing from the spirit and scope thereof.

What is claimed is:

1. A process for preparing an over-based sulfurized alkaline earth metal phenate which comprises reacting a phenol; sulfur; and an alkaline earth metal oxide or hydroxide; in the presence of a dihydric alcohol, with the gram equivalent ratio of the alkaline earth metal oxide or hydroxide per phenolic hydroxyl group of the phenol being maintained at about 0.99 to about 0.001, to obtain a reaction product and then reacting the reaction product with carbon dioxide at a temperature of about 50° to about 230° C.

2. The process of claim 1, wherein the phenol is a phenol which has a hydrocarbon side chain with 4 to 36 carbon atoms and which is liquid at about 120° C.

3. The process of claim 1, wherein the amount of the dihydric alcohol is about 10 to about 65 mol% based on the total mols of the alkaline earth metal oxide of hydroxide, the phenol and the dihydric alcohol.

4. The process of claim 1, wherein the amount of sulfur is about 0.001 to about 4.0 mols per mol of the alkaline earth metal oxide or hydroxide.

5. The process of claim 1, wherein the first step of reaction is carried out at a temperature of 60° to 200° C.

6. The process of claim 1, wherein the reaction of the carbon dioxide with the reaction product is carried out at a temperature of about 80° to about 200° C.

7. The process of claim 1, wherein the process additionally includes maintaining the product which has been reacted with carbon dioxide under an atmosphere of carbon dioxide at about 100° to about 230° C.

8. The process of claim 1, wherein the process includes distilling off unreacted phenol in the presence of a diluent from the reaction product solution obtained after the reaction with carbon dioxide, thereby to obtain a distillation residue.

9. The process of claim 8, wherein the process includes removing any insoluble materials from the reaction product solution prior to the distillation or from the distillation residue obtained after the distillation.

* * * * *